US011186915B2

(12) United States Patent
Garcés Barón

(10) Patent No.: US 11,186,915 B2
(45) Date of Patent: Nov. 30, 2021

(54) ELECTROLYSIS SYSTEM AND METHOD FOR A HIGH ELECTRICAL ENERGY TRANSFORMATION RATE

(71) Applicant: Jorge Garcés Barón, Las Condes (CL)

(72) Inventor: Jorge Garcés Barón, Las Condes (CL)

( * ) Notice: Subject to any disclaimer, the term of this patent is extended or adjusted under 35 U.S.C. 154(b) by 75 days.

(21) Appl. No.: 16/326,001

(22) PCT Filed: Aug. 11, 2017

(86) PCT No.: PCT/CL2017/050040
§ 371 (c)(1),
(2) Date: Feb. 15, 2019

(87) PCT Pub. No.: WO2018/032120
PCT Pub. Date: Feb. 22, 2018

(65) Prior Publication Data

US 2020/0141013 A1 May 7, 2020

Related U.S. Application Data

(60) Provisional application No. 62/375,200, filed on Aug. 15, 2016.

(51) Int. Cl.
*C25B 1/04* (2021.01)
*C25B 15/02* (2021.01)
(Continued)

(52) U.S. Cl.
CPC ..... *C25B 1/04* (2013.01); *C25B 9/70* (2021.01); *C25B 11/00* (2013.01); *C25B 15/02* (2013.01)

(58) Field of Classification Search
CPC ..... C25B 1/04; C25B 1/042; C25B 1/044; C25B 9/70; C25B 15/02
See application file for complete search history.

(56) References Cited

U.S. PATENT DOCUMENTS 4,936,961 A 6/1990 Meyer
7,318,885 B2 1/2008 Omasa
(Continued)

FOREIGN PATENT DOCUMENTS

DE 10 2011 002 104 A1 10/2012

OTHER PUBLICATIONS

International Search Report and Written Opinion dated Dec. 22, 2017 for International Application No. PCT/CL2017/050040, filed Aug. 11, 2017.

*Primary Examiner* — Ciel P Contreras
(74) *Attorney, Agent, or Firm* — Mintz Levin Cohn Ferris Glovsky and Popeo, P.C.

(57) ABSTRACT

The invention relates to an electrolysis system to conduct oxidation and reduction reactions, comprising one or more electrolytic cells, with each one of them being formed by at least a pair of electrodes and an electrolyte provided between said electrodes, wherein the assembly of said one or more electrolytic cells defines an electrolyzer; and an energy source that supplies an electrical signal to the electrolyzer; wherein said electrolytic cell is built in the form of a capacitor of cylindrical plates, wherein said cylindrical plates are defined by the electrodes of the electrolytic cell formed by tubes arranged in a substantially concentric way within each other, thus defining a central electrode, an outer electrode and a space between electrodes, wherein the central electrode corresponds to the anode of the capacitor, the outer electrode to the cathode of the capacitor and the electrolyte to the dielectric means of the capacitor; wherein the electrical signal received by the electrolytic cell or cells that form the electrolyzer correspond to a direct current pulse, wherein said pulse is configured for each electrolyzer's electrolytic cell to operate: In a charge transient regime of each cell during the current pulse; and In a discharge transient regime of each cell during the time between current
(Continued)

pulses; wherein said charge and discharge transient regimes are defined by the construction of each electrolytic cell in the form of a cylindrical plates capacitor. In addition, the invention also relates to associated method and uses.

19 Claims, 8 Drawing Sheets

(51) Int. Cl.
*C25B 11/00* (2021.01)
*C25B 9/70* (2021.01)

(56) References Cited

U.S. PATENT DOCUMENTS

| | | | |
|---|---|---|---|
| 7,615,138 | B2 | 11/2009 | Davidson |
| 8,999,135 | B2 | 4/2015 | Hinatsu et al. |
| 9,340,886 | B1 | 5/2016 | Koeneman et al. |
| 2010/0276299 | A1 | 11/2010 | Kelly et al. |

ELECTROLYSIS SYSTEM AND METHOD FOR A HIGH ELECTRICAL ENERGY TRANSFORMATION RATE

CROSS-REFERENCE TO RELATED APPLICATIONS

This application is a national stage entry, filed under 35 U.S.C. § 371, of International Application No. PCT/CL2017/050040, filed on Aug. 11, 2017, which claims priority to U.S. Provisional Patent Application No. 62/375,200 filed Aug. 15, 2016, and incorporates their disclosures herein by reference in their entireties.

The present invention is related to an improved electrolysis method and system, wherein a controlled supply of pulsating current is implemented and an electrolytic cell design is provided to optimize the capacitive and inductive behavior of the cell. The method and system of the present invention allow adjusting the best amplitude and ratio of the application period of the current pulse to maximize the electrical efficiency of the electrochemical process in the electrolytic cell, wherein production of said cell is maintained under a transient regime making use of the resonant characteristics of the circuit.

BACKGROUND OF THE INVENTION

In the state of the art there are several solutions related to electrolysis systems and methods, which implement a pulsating signal as a supply current, by associating such systems and methods to a special electrode design. For example, the U.S. Pat. No. 3,954,592 teaches an electrolytic cell improving the efficiency by supplying a pulsed DC current to the electrodes thereof. Said document suggests a generally cylindrical anode with a fluted outer surface surrounded by a segmented cathode having an active area equal to the active area of the anode. The pulsing of the current is carried out at a rate of between 5,000 and 40,000 pulses per minute. According to said document, in such an arrangement the current level may be about 220 amps and the electrode voltage may be about 3 volts. Nevertheless, the U.S. Pat. No. 3,954,592 suggests working with a current pulse that cannot be adjusted to maximize the electrical efficiency or to take advantage of the design aspects of the electrolytic cell, thus resulting in an unnecessary energy consumption and the unfeasibility of implementing this solution to a competitive industrial scale. Additionally, the technology of the U.S. Pat. No. 3,954,592 operates the electrolytic cell focusing on its steady state without taking advantage of the transient states thereof.

On the other hand, the U.S. Pat. No. 4,936,961 defines a method for the production of a fuel gas, which comprises a mixture of hydrogen and oxygen obtained from water as a dielectric medium in an electrical resonant circuit. Although said document discloses a method that takes advantages of the resonant features of the circuit, thus implementing a pulsating current, the method in said solution obtains a mixture of hydrogen and oxygen from the breakdown of a water molecule by vibration of the medium generated by electromagnetic fields; this makes the solution a complex one. Furthermore, said documents suggests a capacitive design using water as the dielectric medium, including an inductance connected in series with a capacitor or capacitor. This design allows that the water molecule be subjected to an electric field between the capacitor plates, thus inducing a resonance within the water molecule, whereby the bond between the molecule atoms is broken, thus liberating the hydrogen and oxygen atoms as elemental gases and facilitating the reduction-oxidation reaction. Then, the solution of the U.S. Pat. No. 4,936,961 does not propose the control of operation parameters to maximize the electrical efficiency; therefore, it does not take advantage of the electrolytic cell design to reduce the energy consumption in generating hydrogen and oxygen. Additionally, the technology of document U.S. Pat. No. 4,936,961 operates the electrolytic cell mainly under an approach of steady state not taking advantage of the transient condition characteristics thereof.

By focusing the invention in the generation of hydrogen and oxygen, one of the most relevant uses of the current electrolysis methods and systems is to identify the following processes for the generation of hydrogen and oxygen through electrolysis:

Alkaline electrolysis

Electrolysis by polymer electrolyte membrane (PEM)

Electrolysis at high temperatures or at vapor step

In the electrolytic reaction, the efficiency of the hydrogen produced at the present conditions is about 4.9-5.6 kWh per each $m^3$ of hydrogen produced, i.e. almost 50% to 60% of energy efficiency (considering a lower heat value or LHV of $H_2$), which can be more expensive than the hydrogen obtained from fossil fuels. Additionally, the hydrogen produced in the cathode must be purified, since it may contain oxygen impurities and certain amount of moisture. The hydrogen stream is dried through an adsorbent and the oxygen impurities are removed with a DeOxo converter. The alkaline process, however, is one of the simplest and economic processes for the production of hydrogen.

In addition, although the electrolysis process by PEM has nowadays better yields than alkaline electrolysis, one of the advantages of an alkaline electrolyzer over PEM is the fact of allowing the stability of electrode materials, such as nickel or stainless steel; thus, allowing a structure of much lower cost that does not require expensive materials. Furthermore, the use of PEM procedure has the disadvantage that the exchange membranes are highly sensitive to impurities and also have a limited shelf life time.

Finally, in relation to the process of electrolysis at high temperatures or at vapor step, it should be noted that its main advantage lies on the efficiency higher than ordinary electrolyzers, and its main disadvantage is the availability of an installation of industrial plant for processing high operating temperatures, and the delivery of an important energy supply for the high temperature of the process.

Then, the common problem that these electrolysis technologies side today is the low energy efficiency in the conversion of an energy source for the production of $H_2$ as an energy carrier. Accordingly, up to now a common objective for all these electrolysis systems and methods has been the effort of reducing voltage surges in order to be more energy efficient in the light of the energy transfer, thus reducing production costs.

For that reason, the current efforts to improve the electrolysis cells, apparatuses, systems and methods, mainly for producing hydrogen, focus on the implementation of electrolytes and components of low resistivity or resistance, which reduces the voltage used to achieve higher electrical currents (Ohm's Law). In this sense, the electrolysis models are based on a mainly resistive modeling of the electrolytic cell, where the main objective is addressed to reduce the resistance of the medium (electrolyte) to optimize the process from the point of view of efficiency in energy transfer. In this kind of modeling, applying large voltage surges to the process is usual, and this potential only has been reduced by considerably decreasing the electrolyte resistance.

Therefore, there is a need for improved electrolysis method and system to maximize the electrical efficiency of the electrolysis process by adjusting the operating parameters according to the design of the electrolytic cell that is potentiated in a production model under a transient regime. Furthermore, in the production of hydrogen and oxygen, it is necessary to have a method and apparatus capable of generating such gases separately and at low energy cost, thus maximizing the use of electrical energy.

DESCRIPTION OF THE INVENTION

An objective of the present invention is providing an electrolysis method and system, which maximize the energy efficiency of the electrolysis process, optimizing the operation of the electrolytic cell, which is reflected in maximizing the electrical efficiency of the production process according the following equation:

$$\text{Electrical efficiency} = \frac{\text{Energy of the generated product}}{\text{Consumed electric power}} \quad [\%]$$

In the case of water electrolysis, the energy of the generated product can be consider as the Lower Heating Value (LHV) of $H_2$, which value if 120 [MJ/kg].

Another objective of the present invention is to provide an electrolysis method and system, in which the operating parameters of power supply are adjusted, taking advantage of design aspects of the electrolytic cell by modeling the process, which is not a traditional resistive approach principally.

Another objective of the present invention is to provide an electrolysis method and system that implement an electrolytic cell design, which maximizes the capacitive, inductive and resistive features of the cell, defining the operating parameters, maximum amplitude, frequency and pulse width of electric power, so as to maximize the electrical efficiency of the production process in the electrolysis cell.

Another objective of the present invention is to provide a method and system for hydrogen and oxygen generation by alkaline electrolysis, optimizing the operating parameters and taking advantage of the design of the electrolytic cell to maximize the electrical efficiency.

In order to achieve the preceding objectives, the solution of the present invention comprises a method and a system with a special electrolysis apparatus or electrolyzer fed by a voltage source with pulsating current, which commonly causes decomposition of the electrolyte using electricity. In short, electrolysis is an electrochemical separation process by oxidation-reduction, which takes place when passing electric power through a molten electrolyte or an aqueous solution existing between the electrodes of an electrolytic cell.

In this context, with the aim of maximizing the production of the electrolytic process the electrical current circulating through the cell should be maximized, which should be accompanied by the application of a low voltage to minimize the energy consumption. The present invention models the electrolytic cell capacitively, i.e., like a capacitor, where the electrolyte in the cell is considered as the dielectric medium of the capacitor. This kind of modeling of an electrolytic cell is already known and the most common form thereof consists in defining that the cell is composed of two parallel electrodes plates located at some distance from each other and separated by the electrolyte. Nevertheless, the present invention considers the fact of maximizing the capacitive behavior of the cell and modeling the same as a real capacitor, i.e., including capacitive, resistive and inductive elements as part of the electrolytic cell and focusing the operation thereof on the charging and discharging transient regimes of the cell acting as capacitor.

In this regard, the present invention considers the production of the electrolytic cell under its transient regime, i.e., taking advantage of the transition periods in the electrical behavior of the cell given by its modeling, which is mainly capacitive and inductive. Under its temporary or transient regime, the electrolytic cell behaves according to the evolution of the voltage and current in a capacitor, establishing an electrochemical production in said transient regime. According to a preferred embodiment of the present invention, the cell completely operates under transient regime, applying a differential modeling of Faraday's law to replicate the electrochemical production under said regime. The differential modeling of the unified Faraday's law states that the mass obtained in the production process is a function of time, according to the following equation:

$$d\ \text{Obtained Mass} = K * i(t) * dt, \text{ with } K = \frac{\text{H2 Chemical Equivalent}}{\text{Faraday's Constant}}$$

Then, if the mass obtained in a T period of the pulse wave is calculated, it is obtained as follows:

$$\text{Mass Obtained}_{0\to T} = K * \int_0^T i(t)dt, \text{ with } K = \frac{\text{H2 Chemical Equivalent}}{\text{Faraday's Constant}}$$

Wherein i(t) represents the current density variable in time. This approach is similar to the one of use in direct current, where the constant character of the current applied to the system leaves the equation in its original form with Mass Obtained O→T=K*I*T.

Accordingly, the capacitive features of the electrolytic cell provide an inertial behavior during ascending and descending times of the capacitor's charge, where only the resistive and capacitive effects of model can be seen, which can be reproduced by the equations associated to capacitors and the charge behavior thereof. For instance, the capacitive behavior of the electrolytic cell allows taking advantage of the current peaks that take place at each initial capacitor charge; thus the effective resistance of the cell is substantially reduced during said peaks. Additionally, the electrolytic cell has a resonant behavior with its own natural resonance frequencies given by their construction and inductive behavior, which is combined with the inertia constants provided by the capacitive design.

Then, the invention is based on and electric and constructive architecture, which highlights capacitance and inductance parameters and conditions provided by the resonant and capacitive models of the cell, thus providing a design that does not favor the coexistence of gas produced and electrolyte on the surfaces of gas production, such as stacks or standard dry heap of the industry, but favoring the extraction of the gases produced—by geometry, and implementing current pulses with over-damping transient that favor the release of bubbles from the cell plates. Furthermore, dosing of the energy injected into the cell in resonance condition is implemented, where periods of energy application, duration and amplitude thereof are defined to operate the cell with an electrical performance near the optimum point.

According to an embodiment, the invention proposes the implementation of a direct current (DC) regime with pulse-wave voltage, for example, a squared one, whose pulse width and amplitude are such that the wave average voltage ($V_{average}$) is the optimum voltage ($V_{optimum}$) of the cell production for the respective electrolysis process previously identified as cell potential.

In this respect, there is an optimum voltage for the production of the electrolytic cell known as cell potential, where said optimum or potential voltage corresponds to the minimum voltage possible in order to obtain the maximum efficiency in the energy transfer in the production of the cell, i.e. for the electrochemical reactions to be carried out for which the cell is provided without having losses during the process. This parameter defines that any voltage above the optimum one is considered as over-voltage or over-potential and, therefore, as electrical efficiency loss during the process. The cell's optimum production voltage can be easily calculated according to the electrolysis-associated productive process and considering the oxidation-reduction potentials as example.

The maximum voltage ($V_{max}$), the duration (Δ) and frequency (f) of the wave pulse should be such that, while there is no current supplied to the cell, i.e., between intervals of supply of pulsating current, the cell discharge depending on its capacitive behavior is not higher than a certain value, for example, 10% of the charge value (voltage) reached at the end of the supply period of the pulsating current.

Accordingly, a duration factor of current pulse (D) is defined in order to determine the duration of said pulse according to the period of the pulse wave. In this regard, the pulse duration is given by Δ=D*T, where T is the period of the pulse wave. The duration factor of the pulse wave, also known as Duty Cycle, is kept by virtue of the average and maximum voltages of the pulse generated by the energy source, according to the following equation:

$$D = \left(\frac{V_{average}}{V_{max}}\right)^2 = \left(\frac{V_{optimum}}{V_{max}}\right)^2$$

wherein the effective average voltage is considered as an equivalent of the optimum voltage of the electrolysis process.

Considering the current fed according to the invention, the chart of FIG. 1*a* shows a scheme of the voltage signal obtained from the current source side ($V_{source}$) according to a preferred embodiment of the invention. The chart of FIG. 1*b* shows a scheme of the voltage signal obtained from the electrical charge side ($V_{cell}$) according to a preferred embodiment of the invention.

In the chart of FIG. 1*b*, it can be observed that the electrical behavior of the cell, which is provided by the evolution of the charge or tension thereof, is ruled by the current pulse applied in the time range [xT; xT+DT], with x=0, 1, 2, . . . , n, the resonant or inductive behavior thereof given by the over-damping that takes place just after the end of the current pulse, and by its capacitive behavior in the discharge of the cell, which takes place between the intervals of the current pulse [xT+DT; (x+1)T]. Accordingly, the production of the electrolytic cell is kept under charge transient regime, while the current pulse lasts as under discharge transient regime, between intervals of current pulse, where the current density is provided by the discharge current of the cell. Therefore, the production of the cell is active during the whole cycle of charge and discharge due to the capacitive behavior of the electrolytic cell.

Then, using the discharge equation of a capacitor and defining as design parameters the charge voltages of the cell when t=DT and t=T as $V_{cell}$(DT) and $V_{cell}$(T) respectively, the period/frequency of the pulse wave can be determined by virtue of the following development:

$$V_{cell}(t) = V_{cell}\ \max * e^{\frac{-t}{RC}}$$

with $V_{cell}$ max being the maximum voltage reached by the cell in the charge $$V_c(t=T) = V_{cell}(DT) * e^{\frac{-T}{RC}} = V_{cell}(T)$$

$$T = \frac{1}{f} = RC * \ln\left(\frac{V_{cell}(T)}{V_{cell}(DT)}\right)$$

Wherein:

f is the pulse frequency,

R is the resistance parameter of the cell modeled as capacitor,

C is the capacitance or capacity of the cell modeled as capacitor, and $V_{cell}$(T) and $V_{cell}$(DT) are the design parameters of the electrolytic cell.

The parameters $V_{cell}$(T) and $V_{cell}$(DT) are determined according to the constructive characteristics of each electrolytic cell on the basis of its design as capacitor, considering the evolution of charge under the capacitor's charge and discharge regimes, and under the duration of those regimes according to the characteristics of the current pulse. Additionally, these design parameters should consider the optimum voltage of the electrolysis process that ensures production throughout the discharge period.

Then, using an approach associated to the potential energy provided by the cell as capacitor, and combining with the charge equations of the capacitor, it is possible to calculate the potential energy (U) stored in the cell between t=0 and t=DT:

$$\Delta U_{(U_{DT}-U_0)} = \frac{1}{2}C\left(V_{cell}(t=DT)^2 - V_{cell}(t=0)^2\right)$$

$$\Delta U_{(U_{DT}-U_0)} = \frac{1}{2}C\left[\left(V_{cell}(DT)\left(1-e^{-\frac{DT}{RC}}\right)+V_{cell}(T)\right)^2 - V_{cell}(T)^2\right]$$

It is important to note that the voltage the cell in t=0 is considered equivalent to the voltage of cell when t=T, whether because a n pulse other than the initial under operation regime is considered or considering that the initial charge of the electrolytic cell as capacitor corresponds to $V_{cell}$(T). Anyway, for operating current pulses it is considered that the minimum charge of the cell as capacitor corresponds to $V_{cell}$(T).

Then, and considering that the effective energy provided by the source during the application period of the pulse wave can be expressed according to the effective average voltage ($V_{average}$) and the effective average current ($I_{average}$) as:

$$U_{source}=(V_{average}*I_{average})*T=V_{max}*I_{average}*T*\sqrt{D},$$
$$\text{with } V_{average}=V_{max}*\sqrt{D}$$

By matching the energy provided by the cell as capacitor with the effective energy provided by the source during the pulse duration it is possible to obtain the electric currency of the cell for D and T (or frequency) since:

$$I_{average} = \frac{1}{V_{max} * T * \sqrt{D}} \left\{ \frac{1}{2} C \left[ \left( V_{cell}(DT)\left(1 - e^{-\frac{DT}{RC}}\right) + V_{cell}(T) \right)^2 - V_{cell}(T)^2 \right] \right\}$$

$$I_{averag} = \frac{f}{V_{max} * \sqrt{D}} \left\{ \frac{1}{2} C \left[ \left( V_{cell}(DT)\left(1 - e^{-\frac{D/f}{RC}}\right) + V_{cell}(T) \right)^2 - V_{cell}(T)^2 \right] \right\}$$

Accordingly, and considering the equations for the duration factor D and the frequency f it is possible to obtain the values for the effective average current for several values of the pulse maximum voltage $V_{max}$, using as design parameters the following:

That the effective average voltage $V_{average}$ is equivalent to the optimum voltage $V_{optimum}$ of the electrolytic process in question, The corresponding voltages of the cell at the end of the charge transient $V_{cell}$(DT) and at the end of the discharge transient $V_{cell}$(T), and The constructive parameters of the cell resulting in a resistance3 (R) and capacitance (C) of the cell according to its constructive design as capacitor.

Through the preceding design it is possible to provide an electrolytic cell producing or operating during the whole period T, which is initially ruled by the pulsating current supplied for charging the cell (capacitor) under charge transient regime, and after the pulse ends, when t=DT, ruled by the discharge current of the capacitor under discharge transient regime. Consequently, through the proper current impulse the capacitive system of the cell remains in operation, existing current flow through it, taking advantage of the resonant features thereof given by its capacitive and inductive modeling that maintain continuous operation of the electrolysis process under charge and discharge transient regime, even if the pulse ceases, thus maximizing the energy efficiency of the production process.

Based on the above, the invention comprises an electrolysis system, which design takes advantage of the resonant and capacitive characteristics of the electrolytic cell, improving the electrolysis process according to the objectives of the present invention. In a preferred embodiment, said electrolysis system comprises:

One or more electrolytic cells, with each one of them being formed by at least a pair of electrodes and an electrolyte provided between said electrodes, wherein the assembly of said one or more electrolytic cells defines an electrolyzer; and An energy source that supplies an electrical signal to the electrolyzer;

Wherein said electrolytic cell is built in the form of a capacitor of cylindrical plates, wherein said cylindrical plates are defined by the electrodes of the electrolytic cell formed by tubes arranged in a substantially concentric way within each other, thus defining a central electrode, an outer electrode and a space between electrodes, wherein the central electrode corresponds to the anode of the capacitor, the outer electrode to the cathode of the capacitor and the electrolyte to the dielectric means of the capacitor;

Wherein the electrical signal received by the electrolytic cell or cells that form the electrolyzer correspond to a direct current pulse, wherein said pulse is configured for each electrolyzer's electrolytic cell to operate:

In a charge transient regime of each cell during the current pulse; and

In a discharge transient regime of each cell during the time between current pulses;

Wherein said charge and discharge transient regimes are defined by the construction of each electrolytic cell in the form of a cylindrical plates capacitor.

It is important to note that the configuration of the direct current pulse and the determination of the charge and discharge transient regimes of the electrolytic cell correspond to the development of the equations defining the behavior of capacitors before a pulse signal, as a wave train, with which determining the optimum adjustment of the supplying signal parameters is possible in order to favor the oxidation-reduction reactions occurring inside the cell.

According to an embodiment of the invention, the direct current pulse comprises such an amplitude, duration and frequency that each electrolytic cell of the electrolyzer is energized in its corresponding charge and discharge transient regimes. The direct current pulse has amplitude defined by a maximum or peak voltage of the energy source ($V_{max}$), and an effective average voltage ($V_{average}$), wherein said effective average voltage is defined as the optimum voltage that favors the production of the electrolytic cell, known as cell potential.

According to an embodiment of the invention, the direct current pulse has a duration defined by a factor of direct current pulse duration (D) or working cycle, in relation to the period (T) of said pulse, wherein the direct current pulse duration corresponds to the product between D and T, wherein the working cycle D is defined by the following relation:

$$D = \left( \frac{V_{average}}{V_{max}} \right)^2$$

According to an embodiment of the invention, the direct current pulse has a frequency (f) or period (T) defined as:

$$T = \frac{1}{f} - RC * \ln\left( \frac{V_{cell}(T)}{V_{cell}(DT)} \right)$$

wherein RC is the time constant representing the capacitive and resonant behavior of the electrolytic cell, $V_{cell}$(T) is the voltage of each electrolytic cell when t=T, before receiving a new direct current pulse during the discharge of the capacitor, wherein $V_{cell}$(DT) is the voltage of the electrolytic cell when t=DT when the current pulse ends during the charge of the capacitor.

According to an embodiment of the invention, the direct current pulse generates a current flow circulating through each electrolytic cell, wherein said current flow is defined as:

$$I_{average} = \frac{f}{V_{max} * \sqrt{D}} \left\{ \frac{1}{2} C \left[ \left( V_{cell}(DT)\left(1 - e^{-\frac{D/f}{RC}}\right) + V_{cell}(T) \right)^2 - V_{cell}(T)^2 \right] \right\}$$

According to an embodiment of the invention, the electrolysis system also comprises a control unit communicated with the energy source, wherein said control unit operates the energy source in order to provide the direct current pulse received by the electrolytic cell or cells of the electrolyzer.

According to another embodiment of the invention, the electrolysis system also comprises a control unit in communication with one or more switches arranged between the energy source and the electrolyzer, wherein said control unit operates the activation and deactivation of each switch by controlling the duration and frequency of the current pulse received by the electrolytic cell or cells of the electrolyzer. The control unit can activate and deactivate the switches by supplying the electrical signal provided by the energy source sequentially, distributing the electrical signal over an electrolytic cell for a certain time, thus generating the direct current pulse over each electrolytic cell, wherein said certain time corresponds to the pulse duration. Additionally, the control unit can activate and deactivate the switches by supplying the electrical signal provided by the energy source sequentially, distributing the electrical signal over a first group of electrolytic cells for a certain time and once said time is ended, distributing the electrical signal over a second group of electrolytic cells for a certain time and so on for the total groups operating within the period T. Through this configuration the direct current pulse is generated over each group of electrolytic cells that form part of the electrolyzer, wherein each group is formed by one or more electrolytic cells connected in series. The time determined corresponds to the pulse duration.

According to an embodiment of the invention, the electrolyzer comprises two or more groups of electrolytic cells, wherein said groups of electrolytic cells are connected in parallel. According to an embodiment of the invention, the energy source comprises an alternating current energy source connected to an AC/DC converter.

According to an embodiment of the invention, the reduction reaction takes place over the inner side of the outer electrode and the oxidation reaction takes place over the outer side of the central electrode, wherein the oxidation reaction also takes place alternatively over the inner side of the central electrode. According to this embodiment of the invention, the central electrode comprises one or more openings in its surface that communicate the space between electrodes with the inner space of the central electrode, with said openings allowing the free circulation of the electrolyte between said space between electrodes and the inner space of the central electrode. The opening(s) of the central electrode are provided to allow the product of the oxidation reaction to circulate from the outer side of the central electrode to the inner space.

According to an embodiment of the invention, the openings are located in different zones of extraction of the central electrode, with said zones being distributed along at least one portion of said electrode, preferable an upper portion thereof. Each zone of extraction comprises at least one stopping device arranged over the outer side of the central electrode, wherein said stopping device prevents the circulation of the product of the oxidation reaction over the outer side of the central electrode, conveying said product to the inner space of the central electrode through the holes or openings. According to an embodiment of the invention, the stopping device(s) extend in the space between electrodes, leaving a circulation space for the electrolyte near the inner side of the outer electrode, wherein said circulation space is provided for the free circulation of the product of the reduction reaction. The stopping device(s) correspond to O-rings housed in a groove provided over the outer side of the central electrode. According to an alternative embodiment, the central electrode is surrounded by a separation mesh that facilitates the separation of the products of reactions occurring inside the cell.

According to an embodiment of the invention, the electrolysis system also comprises one or more extraction ducts of the oxidation reaction product, wherein each of said ducts is in communication with the inner space of the central electrode. According to the present embodiment of the invention, the electrolysis system also comprises one or more extraction ducts of the reduction reaction product, wherein each of said ducts is in communication with the space between electrodes.

According to an embodiment of the invention, the electrolyzer is formed by a plurality of electrolytic cells, wherein said electrolytic cells are grouped in one or more groups of cells connected in series, wherein said groups of electrolytic cells connected in series are connected each other in parallel.

According to an embodiment of the invention, the electrolytic cell(s) are vertically arranged and operated at atmospheric pressure, wherein the electrodes making up the cell are formed by hollow vertical tubes.

Additionally, the present invention comprises an electrolysis method to perform the oxidation and reduction reactions in the system described above, with the following steps being comprised:

Providing an electrolysis system as already described;

Applying a direct current pulse over the electrolytic cell(s) forming the electrolyzer of the electrolysis system;

Configuring said direct current pulse for each electrolytic cell of the electrolyzer to operate:

Under a charge transient regime of each cell for the time of duration of the current pulse, and Under a discharge transient regime of each cell for the time between current pulses;

Wherein said charge and discharge transient regimes are defined by the construction of each electrolytic cell in the form of a cylindrical plates capacitor.

Finally, the present invention comprises a system and a method for the production of hydrogen and oxygen by electrolysis or the use of the system and methods described for said purpose previously. For the production of hydrogen and oxygen by electrolysis, the molten electrolyte is on the basis of water, wherein the electrolysis system and apparatus allow separating the water molecule to obtain hydrogen in the cathode and oxygen in the anode. For the water electrolysis to obtain hydrogen and oxygen, the oxidation reaction occurs in the anode and reduction in the cathode as follows:

$$2H_2O \rightarrow O_2 + 4H^+ + 4e \qquad \text{Anode(Oxidation)}$$

$$4H^+ + 4e \rightarrow 2H_2 \qquad \text{Cathode(Reduction)}$$

$$2H_2O \rightarrow 2H_2(gas) + O_2(gas) \qquad \text{Global Reaction}$$

Wherein the hydrogen and oxygen produced generate in the form of bubbles over the cathode surface and the anode surface, respectively, which bubbles detach from the cell surface and move upwards to the extraction points of the applicable gases.

Through the system and method of the present invention an improved electrolysis process is achieved, which maximizes the electrical efficiency of the process by adjusting the operating parameters in order to minimize the energy consumption and optimize the electrolysis process according to the resonant and capacitive design of the electrolytic cell. Furthermore, this allows improving the efficiency of low-cost electrochemical process such as, for example, the alkaline electrolysis for the hydrogen and oxygen production, thus improving the efficiency of said processes and enabling their implementation on an industrial scale.

BRIEF DESCRIPTION OF THE DRAWINGS

As part of the present application the following figures are shown, which are representative of the invention and teach a preferred embodiment thereof; therefore, they should not be construed as limiting the definition of the matter claimed by the present application.

DETAILED DESCRIPTION OF THE PREFERRED EMBODIMENT

Figure 1A:
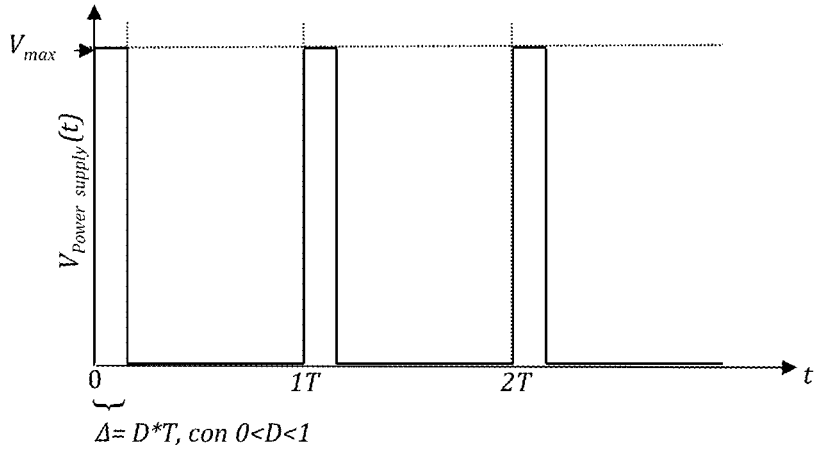
FIGS. 1*a* and 1*b* show charts for the behavior of the voltage signal obtained from the current supply side and for the behavior of the voltage signal from the electrical charge, respectively.
Figure 1B:
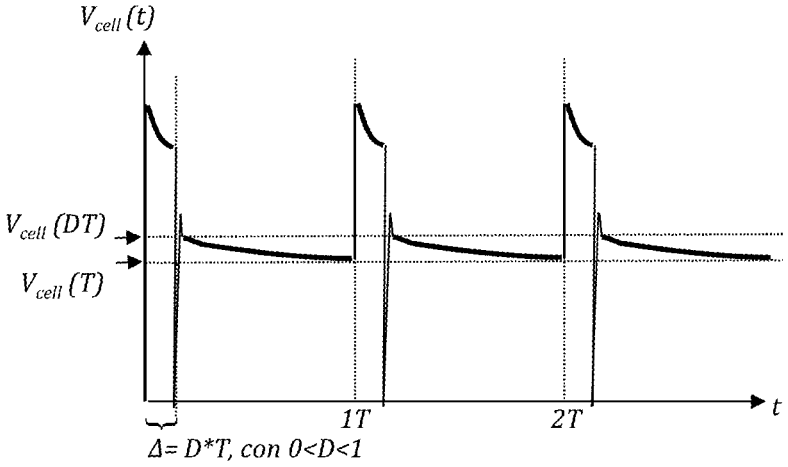

FIGS. 1*a* and 1*b* show voltage versus time charts showing the behavior of the electrical signal both on the supply side (FIG. 1*a*) and on the electrical charge side, i.e. on the electrolytic cell side (FIG. 1*b*). As evidenced from FIG. 1*a*, the form of the voltage signal on the supply side reflects the pulsing nature of the current, showing a maximum voltage ($V_{max}$) that is kept for the duration (Δ) given by the D*T product, wherein D is the duration factor of the current pulse and T is the pulsing wave period. Therefore, the distribution of current delivered by the energy source is shown in a scheme of current intervals over each electrolytic cell, showing a maximum voltage during part of the wave period and null voltage during the remaining part of said period. Additionally, FIG. 1*b* reflects that during the part of the wave period where the maximum voltage is delivered, each electrolytic cell formed by the electrolysis system reaches a cell voltage $V_{cell}(DT)$ given by the cell charge acting as capacitor when t=DT. In the chart of FIG. 1*b* it can be also seen that once the duration of the current pulse ends—in the step where the voltage delivered by the source is null—the electrolytic cell starts its discharge phase, which ends with the termination of the wave period and the start of a new pulse, when t=T. At this time, the cell voltage is given by $V_{cell}(T)$. The equations ruling the charge and discharge processes of the capacitor in terms of cell voltage are:

Charge (rise):

$$V_{cell}(t) = V_{cell\,max} * \left(1 - e^{\frac{-t}{RC}}\right)$$

Discharge (drop):

$$V_{cell}(t) = V_{cell\,max} * e^{\frac{-t}{RC}}$$

Figure 2A:
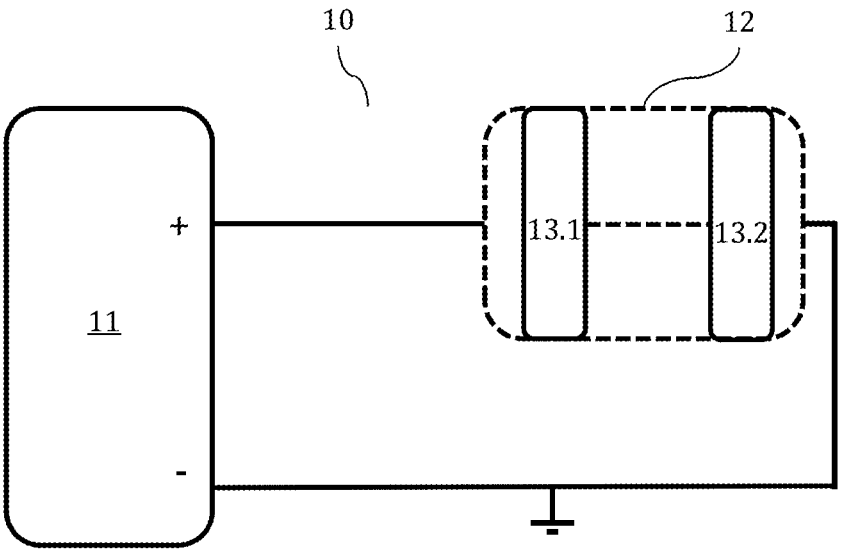
FIGS. 2*a* and 2*b* show schemes of the electrolysis system according to embodiments of the invention.

FIG. 2*a* shows a scheme of an electrolysis system 10 according to an embodiment of the invention comprising an energy source 11 and an electrolyzer. The electrolyzer comprises a first electrolytic cell 13.1 formed by concentric cylindrical electrodes. Under this embodiment, the energy source 11 provides an electrical signal composed of a pulsing current wave according to the invention, which signal is received by the first electrolytic cell 13.1 of the electrolyzer 12. Said signal comprises such an amplitude, duration and frequency that the first electrolytic cell 13.1 operates in a charge and discharge transient regime according to its design characteristics. FIG. 2*a* also shows that the electrolyzer 12 can comprise a second optional electrolytic cell 13.2 connected in series with the first electrolytic cell 13.1 in this case. Under this embodiment the energy source 11 should be designed for the amplitude of the pulsing current wave may ensure that both the first and the second electrolytic cells 13.1, 13.2 operate in charge and discharge transient regimes. Considering that both cells are connected in series in this case, the operation thereof will be simultaneous. If both cells 13.1, 13.2 are identical, the distribution of the voltage provided by the energy source 11 will be equitable with both cells operating in an equivalent form. Here it is important to note that if additional electrolytic cells are connected in series, the energy source 11 shall be sized in order to contribute the necessary energy to operate all cells in series at the same time.

Figure 2B:
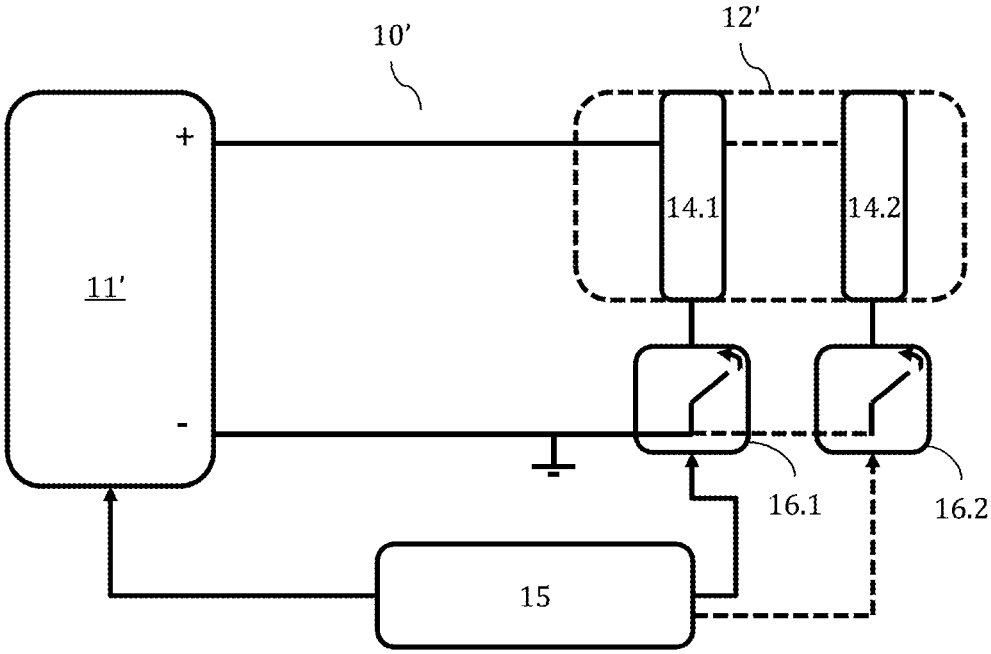

Additionally, FIG. 2*b* shows a scheme of an electrolysis system 10' comprising an energy source 11', an electrolyzer 12', a control unit 15 and at least one switch 16.1. The electrolyzer 12' comprises a first set of electrolytic cells 14.1, where said set formed by two or more electrolytic cells according to the invention is connected in series. Under this embodiment, the energy source 11' can be a direct current source providing direct current of a certain strength and amplitude in order to operate the first set of electrolytic cells 14.1. The control unit 15 is configured in such a way to control the activation or deactivation of a first switch 16.1 connected to the first set of cells, where said switch is in charge of applying the current pulse over the first set of cells 14.1 when opening or closing the circuit. By the activation and deactivation of the first switch 16.1 the current pulse supplying the electrolytic cells connected in series of the first set of cells 14.1 is generated. According to another embodiment, the electrolysis system 10' can comprise a second set of electrolytic cells 14.2 connected in parallel to the first set of cells 14.1, with said second set being formed in an equivalent form to the first set. According to this embodiment, the electrolysis system 10' also comprises a second switch 16.2 connected to the second set of cells in charge of operating in a similar form to that of the first switch, but in relation to the second set of cells 14.2. According to this embodiment, the control unit 15 coordinates the activation and deactivation of the first and second switches 16.1 and 16.2 for the first and second sets of cells 14.1 and 14.2 operate sequentially, taking advantage of the connection in parallel to one single energy source 11'. Thus, the same energy source 11' sized in order to provide current voltage and flow to operate a set of cells in series can be operated to supply two sets of cells connected in parallel, where in first place the first switch 16.1 is activated in order to operate the first set of cells 14.1 and, once the switch has been deactivated according to the duration required for the pulse, the second switch 16.2 is activated in order to operate the second set of cells 14.2. Through the present embodiment, the design of an electrolysis system is possible with multiple sets of electrolytic cells, supplying said cells by the activation and deactivation of multiple coordinated switches to distribute the direct current from one single energy source sequentially over the sets of cells. It is important to note that the design of said electrolysis plant depends on the optimum duration and characteristics of the current pulse, in particular in regard to the pulse duration and frequency factor, which are obtained according to the approach of the present invention.

As an example, if the electrolyzer 12' comprises a first set of electrolytic cells 14.1 formed by 50 cells connected in series, with each cell requiring a peak voltage of 2.5 v, a direct current source of 125*v* will be required to supply these 50 cells, distributing said 125 v in an equivalent form over each one of the 50 cells. This configuration can be supplemented with additional groups of electrolytic cells 14.2 connected in parallel to the first group, with each group having a switch in communication with the control unit for the pulsed distribution of direct current provided by the energy source. The number of groups of cells connected in parallel will be defined preferably according to the duration factor of the current pulse.

Figure 3:
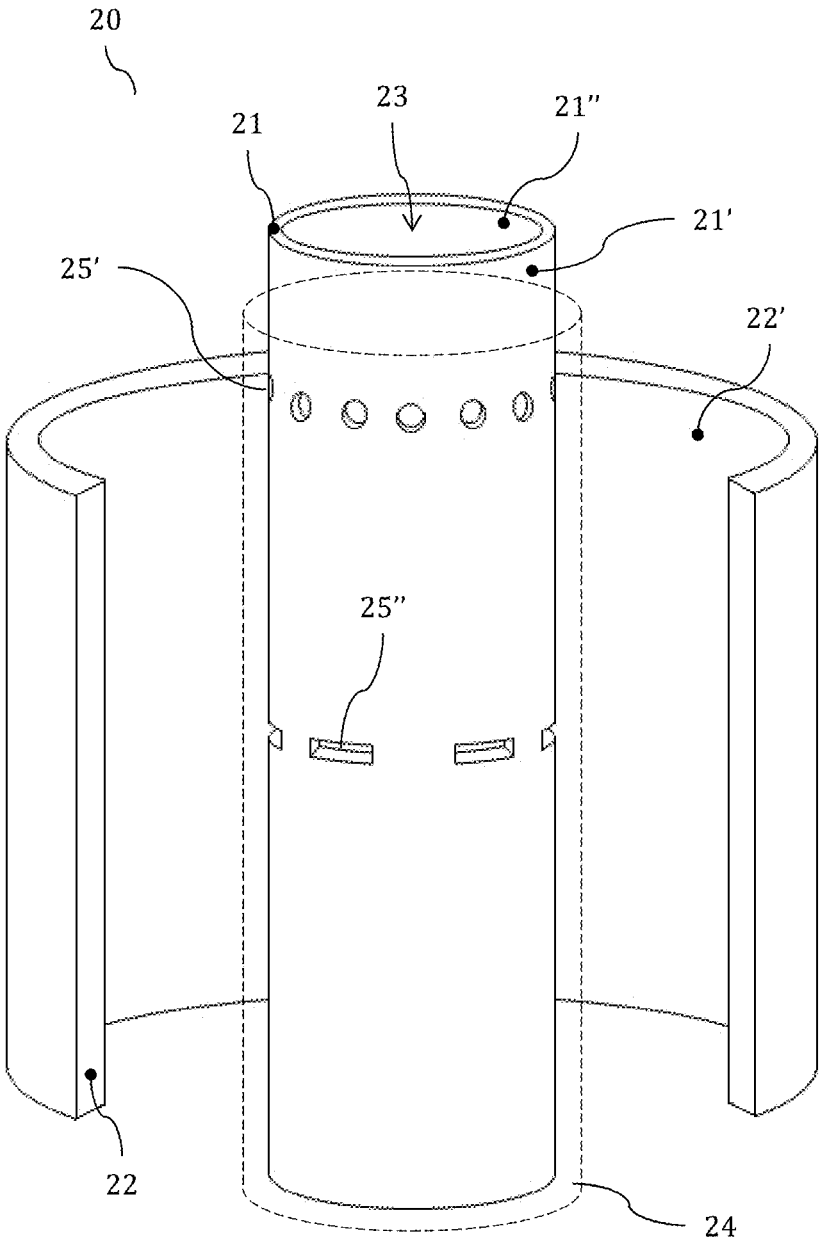
FIG. 3 shows a cross-section view of the electrodes of the electrolytic cell according to an embodiment of the invention.

FIG. 3 shows a scheme of the electrodes of an electrolytic cell 20 formed by cylindrical electrodes 21, 22 according to the preferred embodiment of the present invention. Said electrodes are comprised by an arrangement of substantially concentric cylindrical electrodes, wherein there is a central hollow cylindrical electrode 21 and an outer electrode 22 of the cylindrical mantle surrounding the central cylindrical electrode 21. The central electrode 21 defines an inner space 23. In the central electrode 21 there is the oxidation reaction (generation of $O_2$ in the case of water electrolysis). Over the inner side 22' of the outer electrode 22 the reduction reaction 22 occurs (generation of $H_2$ in the case of water electrolysis). Both electrodes are separated each other by a space with an electrolyte provided in said space (in the case of hydrogen and oxygen generation, the electrolyte is based on water).

According to an embodiment, the central electrode 21 comprises openings in its surface allowing electrolytes entering the inner space 23 of the central electrode and the circulation of ions, and also allowing the oxidation reaction to occur both in the outer side 21' of the central electrode 21 and in the inner side 21" thereof. Additionally, and alternatively, the central electrode 21 can be surrounded by a separation mesh 24 with a physical barrier of separation provided that separate the oxidation zone (central electrode 21) from the reduction zone (outer electrode 22), thus facilitating the separation of gases generated in the electrolytic cell. Under this arrangement, the central electrode 21 comprises separation means (not shown) that keep distance between the separation mesh 24 and the outer side 21' of the central electrode 21, allowing the generation of the oxidation product over the surface of said outer side 21'. Additionally, this distance allows the gas generated on the outer side 21' of the central electrode 21 to circulate to its extraction point, whether by going into the inner space 23 of the central electrode 21 through the openings or circulating over the outer side 21' of the electrode into the extraction point without being transferred to the generation zone of the reduction product.

In regard as openings, according to alternative embodiments, they may be formed by circular holes 25' and/or continuous grooves 25". The openings distribute along at least one part of the central electrode 21, preferably an upper part thereof, distributed in the extraction zones 27 provided to communicate the space between electrodes with the inner space of the central electrode 21.

The constructive aspects of the electrodes according to the preferred embodiment allow taking advantage of the capacitive and resonant characteristics of the electrolytic cell, preventing the saturation of the walls of the electrodes with the gases generated by maximizing the cell's resonant aspects, including the effect of overdamping and taking advantage of the diffusion and transfer of ions from one electrode to other in the standby cycle given by the intervals in the current supply of pulsing wave making use of the cell's capacitive aspects.

Figure 4:
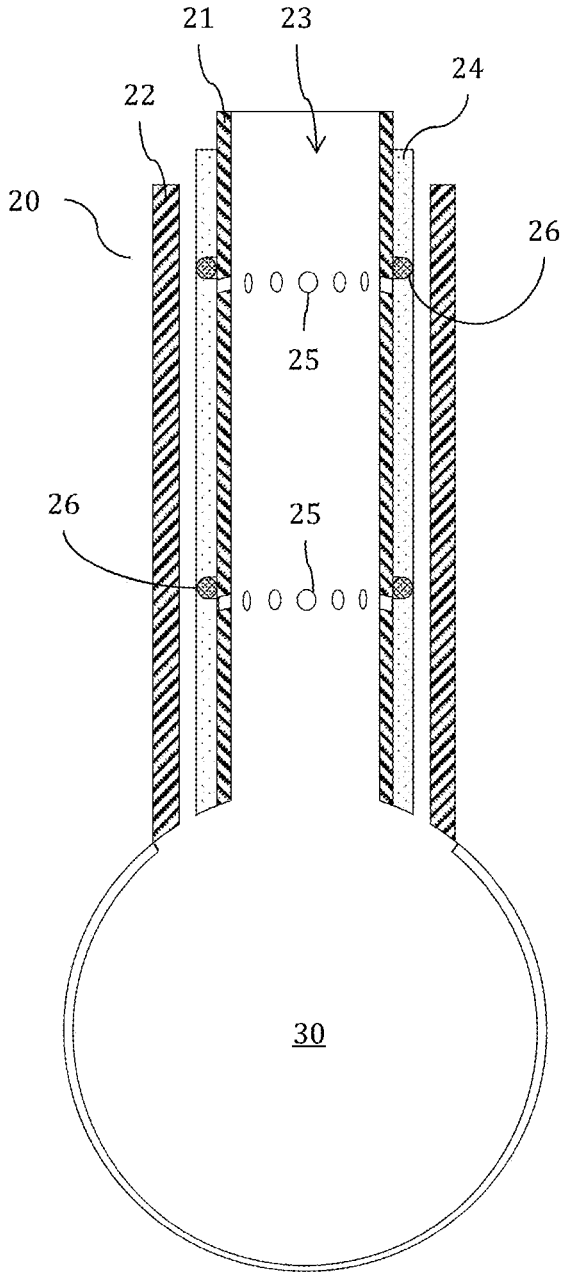
FIG. 4 shows a cross-section view of a lower section of an electrolytic cell according to an embodiment of the invention.

FIG. 4 shows a cross-section view of the lower part of an electrolytic cell 20 showing the preferred arrangement of the central electrode 21, the outer electrode 22, the separation mesh 24 and the inner space 23. Additionally, two extraction zones 25 are shown distributed over the extension of the central electrode 21 and the arrangement of the stopping devices 26 in said zones, formed in this case as O-rings. On the other hand, to the lower end of the electrolytic cell illustrated in FIG. 4, the cross-section of a feeding duct of electrolyte 30 is seen, where said duct is in communication with the central space 23 and/or the space between electrodes in order to feed the electrolyte to the electrolytic cell.

Figure 5:
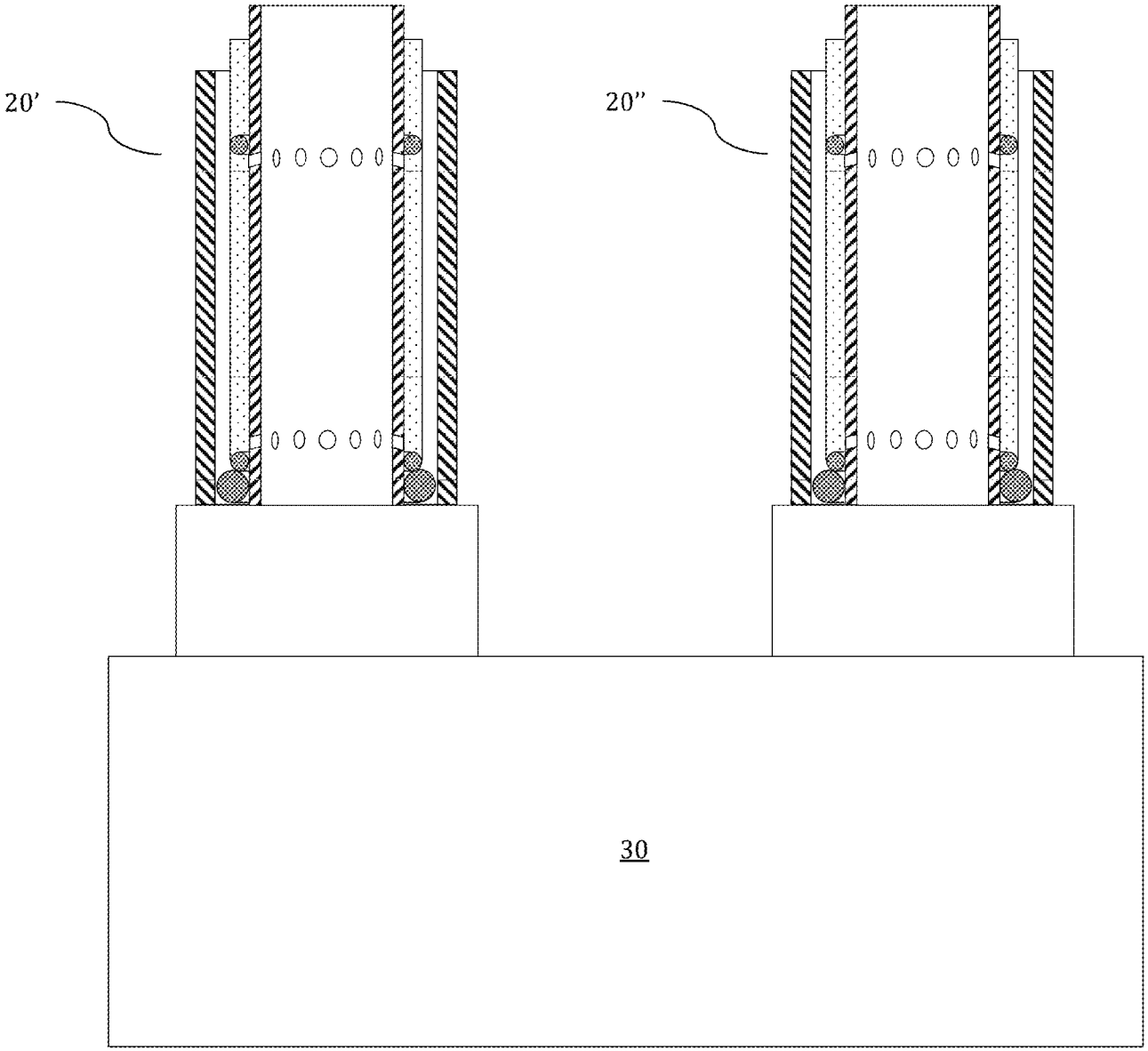
FIG. 5 shows a cross-section view of a lower section of two electrolytic cells according to an embodiment of the invention.

FIG. 5 shows a representative scheme of two electrolytic cells 20' and 20" according to FIG. 4 in cross section along the direction of the electrolyte feeding duct 30, with both cells being connected through the same electrolyte feeding duct 30. Under this embodiment, the electrolytic cells 20' and 20" can be electrically connected in series or in parallel, but the preferred connection is the electrical one in series by sharing the same electrolyte feeding and, thus, by operating simultaneously they decompose the electrolyte.

Figure 6:
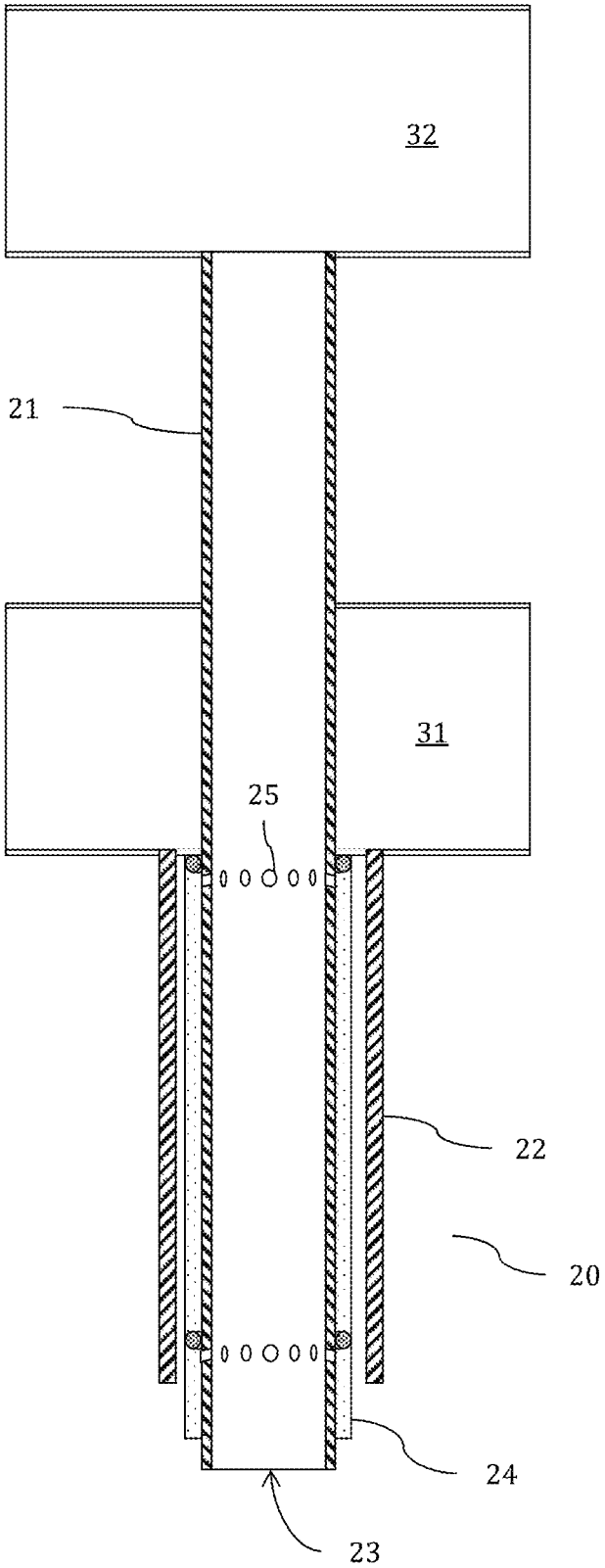
FIG. 6 shows a cross-section view of an upper section of an electrolytic cell according to an embodiment of the invention.

FIG. 6 shows a cross section view of an upper part of an electrolytic cell 20 showing the extraction points of the oxidation and reduction reaction products occurring therein. In fact, an extraction duct of the reduction product 21 is shown in communication with the outer electrode 22 for the recovery of the reduction product formed on the surface of said outer electrode 22. Additionally it is shown how the central electrode 21 extends through the extraction duct of the reduction product 31 up to an extraction duct of the oxidation product 32, wherein the inner space 23 of the central electrode 21 is communicated with said extraction duct of the oxidation product 32. According to this configuration, the extraction zones 25 with openings and stopping devices 26 favoring the circulation of the oxidation reaction product into the inner space 23 of the central electrode 21, along with the characteristics of the electrolysis process, wherein each products is formed over the subsides of different electrodes, allows facilitating the separation of both electrolysis products, with them being extracted in separate extraction ducts 31, 32 in order to have those products in later steps, for example for compression and storage.

Figure 7:
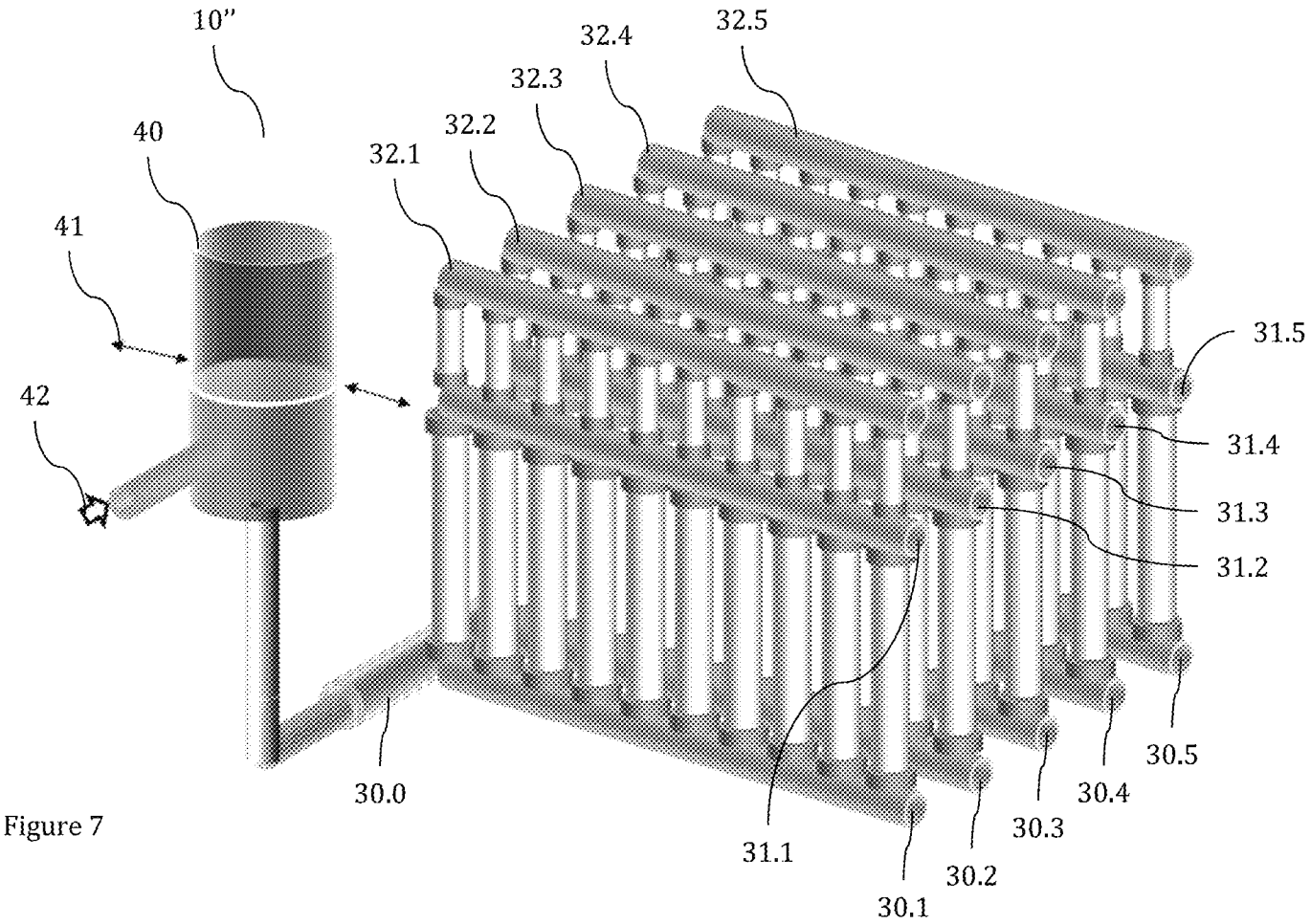
FIG. 7 shows a perspective view of the electrolysis system according to an embodiment of the invention.

FIG. 7 shows a scheme of an electrolysis system 10" comprising multiple electrolytic cells provided in communication with multiple feeding and extraction ducts. In particular, the embodiment represented in FIG. 7 shows five groups of electrolytic cells bound by the applicable feeding ducts of the electrolyte (30.1, 30.2, 30.3, 30.4 and 30.5) and the corresponding extraction ducts of the reduction reaction product (31.1, 31.2, 31.3, 31.4 and 31.5), and the corresponding extraction ducts of the oxidation reaction product (32.1, 32.2, 32.3, 32.4 and 32.5) under a similar scheme to that of FIGS. 5 and 6. Additionally, FIG. 7 shows the arrangement of a feeding tank 40 arranged to keep the electrolyte's operating level 41 inside the electrolytic cells, thus providing feeding to the feeding ducts of the electrolyte through a main feeding duct 30.0. The feeding tank 40 may comprise an electrolyte's feeding path 42 from the outside in order to compensate the decomposition of the electrolyte during the process. The arrangement of the electrolytic cells of FIG. 7 can be useful to take advantage of the present invention, comprising cells connected in series forming groups of cells, wherein said groups of cells are connected in parallel using switches and at least one control unit distributing a current signal in order to provide a rightly sized current pulse to each group of cell in a similar way to that stated in the scheme for FIG. 2*b*.

Figure 8:
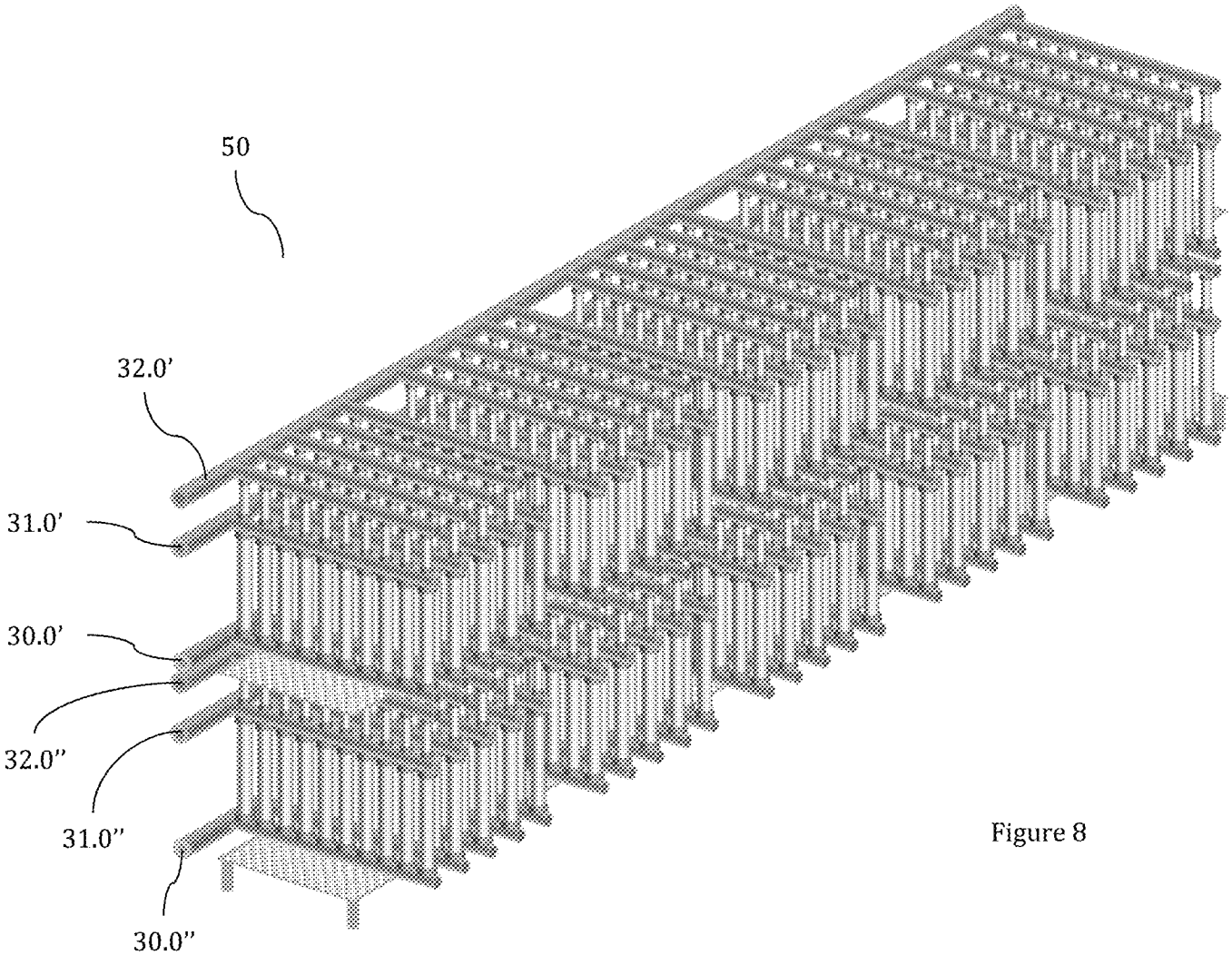
FIG. 8 shows a perspective view of an electrolysis plant according to an embodiment of the invention.

Finally, FIG. 8 shows a scheme of an electrolytic plant 50 comprising the system of the invention, generating arrangement of cells that can be operated under the same concept proposed in the present invention, using main feeding ducts 30.0', 30.0", main extraction ducts of the reaction products 31.0', 31.0", and main extraction ducts of the oxidation reaction products 32.0', 32.0". This scheme allows designing one or more feeding sources for the feeding of each arrangement of cells in order to cover the needs of current and voltage according to the statements of the invention and to provide a sequential production of each set of cells according to the requirements of current pulse frequency and duration according to the statements of the present invention. With this not only the electrolysis process' operating aspects in the electrolytic cells are optimized, but also the industrial aspects of an installation of this type of system in a compact electrolysis plant, for example for producing hydrogen and oxygen at industrial scale.

Working Example

In order to exemplify the implementation of the solution proposed by the present invention, the production of hydrogen and oxygen through water electrolysis is considered, using the system and methods of the present invention.

In the process of water alkaline electrolysis to generate $H_2$ and $O_2$, processes of oxidation and reduction take place as follows:

$$2H_2O \rightarrow O_2 + 4H^+ + 4e \qquad \text{oxidation (anode)}$$

$$4H^+ + 4e \rightarrow 2H_2 \qquad \text{Reduction (cathode)}$$

$$2H_2O \rightarrow 2H_2 + O_2 \qquad \text{Overall reaction}$$

The electrolysis of a mole of water produces one mole of hydrogen gas and half mole of oxygen gas in the normal diatomic forms thereof. A detailed analysis of the process shows the use of the thermodynamic potentials and the first law of thermodynamics. It is assumed that this process is carried out at 298° K and at one atmosphere of pressure, and that the relevant values are taken from the following table of thermodynamic properties (table 1):

TABLE 1

| Amount | $H_2O$ | H | $0.5O_2$ | Change |
|---|---|---|---|---|
| Enthalpy | −285.83 kJ | 0 | 0 | H = 285.83 kJ |
| Entropy | 69.91 J/K | 130.68 J/K | 0.5 × 205.14 J/K | TS = 48.7 kJ |

The process must provide energy for the dissociation plus the energy to expand the produced gases. Both are included in the enthalpy change of the above table. At a temperature of 298° K and one atmosphere of pressure the system operation is as follows:

$$W = P\Delta V = (101.3\times103\ \text{Pa})(1.5\ \text{mol})(22.4\times10^{-3}\ \text{m}^3/\text{mol})(298\ \text{K}/273\ \text{K}) = 3715\ \text{J}$$

As the enthalpy H=U+PV, the change of internal energy Y is therefore:

$$\Delta U = \Delta H - P\Delta V = 258.83\ \text{kJ} - 3.72\ \text{kJ} = 282.1\ \text{kJ}$$

This change in the internal energy must be accompanied by the expansion of the gases produced, so the change in enthalpy represents the energy necessary to carry out the electrolysis. Nevertheless, it is not necessary that the energy source inserts this energy in total, as electrical power, since the entropy increases in the dissociation process; the TΔS amount can be provided by the environment at temperature T. Then, the amount of energy to be supplied by the energy source is in fact the change in Gibbs' free energy, which is expressed as follows:

$$\Delta G = \Delta H - T\Delta S = 285.83\ \text{kJ} - 48.7\ \text{kJ} = 237.1\ \text{kJ}$$

As the result of the electrolysis process there is an increase of the entropy, the environment "helps" the process by providing a TΔS amount. The usefulness of Gibbs' free energy consists in indicating the amount of other energy forms that must be supplied in order to execute the process.

For practical purposes of calculating the mass obtained in an electrolysis process, and considering the unified Faraday's law and a distribution of constant current, the equation can be presented as:

$$\text{Obtained Mass [gr]} = \frac{\left(\text{Chemical Equivalent}\,H_2\left[\frac{\text{gr}}{\text{mol}}\right] * I\left[\frac{\text{Coulomb}}{s}\right] * t[s]\right)}{\text{Faraday's Constant}\left[\frac{\text{Coulomb}}{\text{mol}}\right]}$$

For hydrogen, the electro-chemical equivalent is:

$$\text{Chemical Equivalent}\,H_2 = 1{,}00794\left[\frac{\text{gr}}{\text{mol}}\right]$$

Using the known values of the Chemical Equivalent of $H_2$ and Faraday's Constant, and considering the generation of 1 g of $H_2$ in one second, the following is obtained:

$$I = 95724.9\ \text{A}$$

With this information it is possible to calculate the optimum voltage matching the input energy of the cell with the output energy. In this case, once the current necessary has been obtained to produce one unit of mass of the reaction product using the chemical equivalent to said product for that purposes, it is possible to determine the electrical energy required at the cell entry for the time of 1 second, for the production of one gram $H_2$ through the following equation:

$$\text{Entry energy} = \int_{t=0}^{t=1[s]} (I * V_{optimal})\,dt$$

Then, and considering the output energy as the thermal product of the reaction, this case considering that the energy contained in 1 gram of $H_2$ is 120011 J (Low Heat Value) and considering a 100% electrical efficiency, the following result is obtained:

$$V_{optimal} = 1.24[\text{v}]$$

Here it is important to note that the electrolysis process for the generation of hydrogen is widely known; thus, it is not an object of the present invention to restate the thermodynamics balances and equations associated with said process. Without prejudice to that and as shown by the present example of application, the optimum application to favor reactions in the production of hydrogen through electrolysis is about 1.24 volts, so that to obtain the maximum efficiency of energy transformation.

The optimum voltage can be also obtained by applying the standard potentials of reduction corresponding to the potentials measured in each electrode to favor the reduction and oxidation processes under standard conditions. Using the standard potentials of reduction, it can be defined that the oxidation reactions in the anode ($2H_2O \rightleftharpoons O_2+4H^++4e$) has a reduction potential of 1.229 V, while the reduction reaction in the cathode ($4H^++4e \rightarrow 2H_2$) has a potential of 0 V, with this valued being defined as the reduction potential in reference. Then, it is possible to calculate the potential of the cell ($E_{cell}^o$) as follows:

$$E_{cell}^o = E_{cathode}^o - E_{anode}^o$$

Wherein $E_{cathode}^o$ and $E_{anode}^o$ correspond to the potential standards of the cathode and anode for this reaction, respectively. Then, for the electrolytic cell in question the potential of the cell would be −1.229 V, this being the necessary potential to carry out the non-spontaneous reaction of hydrogen and oxygen production through water electrolysis.

With this optimum voltage of the electrolysis process and with the cell design consideration, operating parameters of the current power supply can be obtained such as pulse duration time, frequency and amplitude thereof, thus optimizing the application of current by minimizing the voltage required to operate the electrolytic cell in a resonant and capacitive fashion. In fact, by using this value and the above-defined equations the duration factor of the current pulse is:

$$\sqrt{D} = \frac{1.24[v]}{V_{max}}$$

Therefore, the duration of the pulse wave is:

$$D * T = \left(\frac{1,24}{V\max}\right)^2 * R * C * 0.105[s]$$

Then, the current flowing through the cell under these design parameters is configured as:

$$I_{average} = \frac{f}{\left(V_{max} * \sqrt{D}\right)}\left(\frac{1}{2}C\left(2\left(1 - e^{-\frac{D/f}{RC}}\right) + 1,8\right)^2 - 1.62\ C\right) \quad [A]$$

Obtaining the current values for several values of $V_{max}$.

Considering a power supply with $V_{max}$=2.52 v is it possible to determine that the pulse duration factor is D≈0.24 for the optimum voltage desired. Then, considering the equation for the period and frequency and a high-capacitance electrolytic cell according to design parameters, as for example with a capacitance of 1.1 F and with a resistance resulting in a duty cycle of 0.18 ohm, it is possible to obtain that the pulse wave frequency supplying power to the system is about 50 Hz (a period of 0.02 seconds).

With this information it is possible to calculate the current circulating through the cell, which in this case is about 7.19 A. Then, using the ohm law it is possible to evidence that applying an optimum voltage to an electrolytic cell under the constructive parameters of a high-capacitance capacitor and under the operating parameters of the present invention in transient regimes, results in an apparent resistance of the system of 0.17 ohm, which is an advantageous situation compared with the standard electrolytic cells. In fact, below comparative values are presented between a standard cell operated in a standard way with direct current (table 2) and a cell according to the present invention and operated according to the solution stated (table 3), both of them under the same parameters of amplitude and current flow.

TABLE 2

| Effective current [A] | Production $H_2$ [gr/hr] | $H_2$ energy [Wh] | Efficiency [%] | Energy consumed [Wh] | Effective resistance [ohm] | Effective voltage [V] | Consumption per kilo of $H_2$ [kWh/kg] |
|---|---|---|---|---|---|---|---|
| 7.19 | 0.27 | 9.02 | 60.0% | 15.0 | 0.2906 | 2.09 | 55.6 |

TABLE 3

| Effective current [A] | Effective voltage [V] | Effective resistance [ohm] | $H_2$ production [gr/hr] | $H_2$ energy [Wh] | Energy consumed [Wh] | Consumption per kilo of $H_2$ [kWh/kg] |
|---|---|---|---|---|---|---|
| 7.19 | 1.27 | 0.177 | 0.27 | 9.02 | 9.1 | 33.3 |

Then, and considering the design parameters, wherein the cell charge voltage in t=DT is $V_{cell}(DT)$=2 [v] and the cell voltage in t=T is $V_{cell}(T)$=1.8 [v], with those parameters being defined according to the constructive aspects of the cell, the frequency parameter (period) of the pulse wave is:

$$f = \frac{1}{T} = \frac{1}{R * C * 0.105}[Hz]$$

In view of the above, it is possible to prove that for the same level of $H_2$ production—considering the electrolysis system of the invention compared with a conventional system—reducing the energy consumption of the cell about 40% is possible, which translates into a substantial reduction of the disadvantages of implementing the alkaline electrolysis process at industrial scale. The big differences resulting between the implementation of a conventional solution and the solution of the present invention are given by the constructive considerations of the cell as capacitor, considering the capacitive and inductive aspects, along with the resistive ones in order to operate the cell under charge and discharge transient regimes. This approach results in current peaks over the electrolytic cell at the beginning of each charge period, which reflects in an apparent or reduce effective resistance, in this case about 0.17 ohm. Taking advantage of said current peak through supplying pulse wave and operation under transient regimes translates into increased efficiency, which exceeds the operation of a conventional cell and making the industrial solutions for the production of hydrogen and oxygen in an alkaline way competitive.

At this point it should be highlighted that the preceding example of application can be extrapolated to other electrolysis processes, being relevant to calculate the optimal voltage of this process and consider the transient regimes of the electrolytic cell both in charge as in discharge, where the capacitive, inductive and resonant aspects of said cell should be stressed.

The invention claimed is:

1. An electrolysis system to conduct oxidation and reduction reactions, comprising:

an electrolyzer having two or more groups of electrolytic cells, each electrolytic cell being formed by at least a pair of electrodes and an electrolyte provided between the electrodes;

an energy source being connected to and supplying an electrical signal to the electrolyzer, wherein the electrical signal corresponds to a direct current pulse including a plurality of current pulses, the direct current pulse being characterized by a frequency (f) and a period (T); and a control unit being connected to and controlling the energy source or one or more switches connected to and being positioned between the energy source and the electrolyzer, the controlling including providing a sequential supply of the electrical signal, distributing the electrical signal over a first group of the electrolytic cells for a first certain time in a plurality of certain times, the plurality of certain times forming a duration of the direct current pulse, once the first certain time ends, distributing the electrical signal over a second group of the electrolytic cells for a second certain time in the plurality of certain times, and generating a current pulse in the plurality of current pulses over each group of the electrolytic cells within the period (T) of the direct current pulse;

wherein the electrolytic cells form a capacitor having cylindrical plates, wherein the cylindrical plates are defined by the electrodes of the electrolytic cells formed by tubes arranged in a substantially concentric way within each other to define a central electrode, an outer electrode and a space between electrodes, wherein the central electrode corresponds to an anode of the capacitor, the outer electrode to a cathode of the capacitor and the electrolyte to a dielectric means of the capacitor;

wherein each electrolytic cell of the electrolyzer, during the direct current pulse, is configured to operate:

under a charge transient regime during each current pulse in the plurality of current pulses; and under a discharge transient regime between adjacent current pulses in the plurality of current pulses;

wherein the charge and discharge transient regimes are defined by a construction of each electrolytic cell; and wherein the direct current pulse comprises an amplitude, the duration and the frequency (f) determined such that each electrolytic cell of the electrolyzer is energized in its corresponding charge and discharge transient regimes.

2. The system according to claim 1, wherein the central electrode is a hollow cylindrical electrode that defines an inner space, wherein a reduction reaction takes place over the inner side of the outer electrode and an oxidation reaction takes place over an outer side of the central electrode, wherein the oxidation reaction takes place alternatively over the inner side of the central electrode;

wherein the system further comprising one or more first extraction ducts for extraction of a product of the oxidation reaction, wherein each of the first extraction ducts is in communication with the inner space of the central electrode; and one or more second extraction ducts for extraction of a product of the reduction reaction, wherein each of the second ducts is in communication with the space between electrodes.

3. The system according to claim 2, wherein the central electrode comprises one or more openings in its surface that communicate the space between electrodes with the inner space of the central electrode, with the one or more openings allowing a free circulation of the electrolyte between the space between electrodes and the inner space of the central electrode, wherein the one or more openings of the central electrode are provided to allow the product of the oxidation reaction to circulate from the outer side of the central electrode to the inner space of the central electrode.

4. The system according to claim 3, wherein the one or more openings are located in different zones of extraction of the central electrode, with the extraction zones being distributed along at least one portion of the central electrode, where each zone of extraction comprises at least one stopping device arranged over the outer side of the central electrode, wherein the at least one stopping device prevents a circulation of the product of the oxidation reaction over the outer side of the central electrode, conveying the product to the inner space of the central electrode through the one or more openings, wherein the at least one stopping devices extend in the space between electrodes, leaving a circulation space for the electrolyte near the inner side of the outer electrode, wherein the circulation space is provided for the free circulation of the product of the reduction reaction.

5. The system according to claim 1, wherein the amplitude of the direct current pulse is defined by a maximum or peak voltage of the energy source ($V_{max}$), and an effective average voltage ($V_{average}$), wherein the effective average voltage is defined as the optimum voltage that favors a production of each electrolytic cell, and wherein the duration of the direct current pulse is defined by a duration factor (D) of the direct current pulse, or working cycle, in relation to the period (T) of the direct current pulse, wherein the duration of the direct current pulse corresponds to a product between D and T, and wherein the duration factor D is defined by:

$$D\left(\frac{V_{average}}{V_{max}}\right)^2.$$

6. The system according to claim 5, wherein the frequency (f) or the period (T) of the direct current pulse is defined as:

$$T = \frac{1}{f} = RC * \ln\left(\frac{V_{cell}(T)}{V_{cell}(DT)}\right)$$

wherein RC is the time constant representing the capacitive and resonant behavior of each electrolytic cell, $V_{cell}(T)$ is the voltage of each electrolytic cell when time t=T, before receiving a new direct current pulse during the discharge of the capacitor, wherein $V_{cell}(DT)$ is the voltage of each electrolytic cell when time t=DT when the direct current pulse ends during the charge of the capacitor, and wherein D is the duration factor.

7. The system according to claim 5, wherein the direct current pulse generates an effective average current flow circulating through each electrolytic cell, wherein the current flow is defined as:

$$I_{average} = \frac{f}{V_{max} * \sqrt{D}}\left\{\frac{1}{2}C\left[\left(V_{cell}(DT)\left(1 - e^{-\frac{D/f}{RC}}\right) + V_{cell}(T)\right)^2 - V_{cell}(T)^2\right]\right\}.$$

wherein $I_{average}$ is the average current flowing through each electrolytic cell, C is the capacitance of each electrolytic cell, $V_{cell}(DT)$ is the voltage of each electrolytic cell when time t=DT when the direct current pulse ends during the charge of the capacitor, e is the Euler's number, RC is the time constant representing the capacitive and resonant behavior of each electrolytic cell, and $V_{cell}(T)$ is the voltage of each electrolytic cell when time t=T.

8. The system according to claim 1, wherein the control unit operates the energy source in order to provide the direct current pulse received by the electrolytic cells of the electrolyzer.

9. The system according claim 1, wherein the control unit operates an activation and a deactivation of each switch in the one or more switches by controlling the duration and the frequency of the direct current pulse received by each of the electrolytic cells, wherein the control unit activates and deactivates the one or more switches to supply the electrical signal provided by the energy source sequentially, distributing the electrical signal over the first and second groups of the electrolytic cells, wherein each group of the electrolytic cells is formed by two or more of the electrolytic cells connected in series.

10. The system according to claim 1, wherein said two or more groups of the electrolytic cells are connected in parallel.

11. The system according to claim 1, wherein the central electrode is surrounded by a separation mesh.

12. The system according to claim 1, wherein the electrolytic cells are vertically arranged and operated at atmospheric pressure, wherein the electrodes making up the cells are formed by hollow vertical tubes.

13. An electrolysis method for conducting one or more oxidation reactions and reduction reactions, comprising:

providing an electrolysis system, comprising:

an electrolyzer having two or more electrolytic cells, with each electrolytic cell being formed by at least a pair of electrodes and an electrolyte provided between the electrodes;

an energy source being connected to and supplying an electrical signal to the electrolyzer; and a control unit being connected to the energy source or to one or more switches connected and being positioned between the energy source and the electrolyzer;

wherein the electrolytic cells form a capacitor having cylindrical plates, wherein the cylindrical plates are defined by the electrodes of the electrolytic cells formed by tubes arranged in a substantially concentric way within each other to define a central electrode, an outer electrode and a space between electrodes, wherein the central electrode corresponds to an anode of the capacitor, the outer electrode to a cathode of the capacitor and the electrolyte to a dielectric means of the capacitor;

applying the electrical signal over the electrolytic cells, wherein the electrical signal corresponds to a direct current pulse including a plurality of current pulses, the direct current pulse being characterized by frequency (f) and a period (T);

controlling the energy source or the one or more switches, the controlling including providing a sequential supply of the electrical signal, distributing the electrical signal over a first group of the electrolytic cells for a first certain time in a plurality of certain times, the plurality of certain times forming a duration of the direct current pulse, the plurality of certain times forming a duration of the direct current pulse, once the first certain time ends, distributing the electrical signal over a second group of the electrolytic cells for a second certain time in the plurality of certain times, generating a pulse of the current pulses in the plurality of current pulses over each group of the electrolytic cells within the period (T) of the direct current pulse; and configuring each electrolytic cell of the electrolyzer, during the direct current pulse, to operate:

under a charge transient regime during each current pulse in the plurality of current pulses; and under a discharge transient regime between adjacent current pulses in the plurality of current pulses;

wherein the charge and discharge transient regimes are defined by a construction of each electrolytic cell; and wherein the configuring includes determining an amplitude, the duration and the frequency (f) of the direct current pulse such that each electrolytic cell of the electrolyzer is energized in its corresponding charge and discharge transient regimes.

14. The method according to claim 13, wherein the configuring further comprises defining the amplitude for the direct current pulse by a maximum or peak voltage of the energy source ($V_{max}$), and an effective average voltage ($V_{average}$), wherein the effective average voltage is defined as the optimum voltage that favors a production of each electrolytic cell; and defining the duration of the direct current pulse by a duration factor (D) of the direct current pulse, or working cycle, in relation to the period (T) of the direct current pulse, wherein the duration of the direct current pulse corresponds to a product between D and T, and wherein the duration factor D is defined by:

$$D\left(\frac{V_{average}}{V_{max}}\right)^2.$$

15. The method according to claim 14, wherein the configuring further comprises defining the frequency (f) or the period (T) of the direct current pulse as:

$$T = \frac{1}{f} = RC * \ln\left(\frac{V_{cell}(T)}{V_{cell}(DT)}\right)$$

wherein RC is the time constant representing the capacitive and resonant behavior of each electrolytic cell, $V_{cell}(T)$ is the voltage of each electrolytic cell when time t=T, before receiving a new direct current pulse during the discharge of the capacitor, and wherein $V_{cell}(DT)$ is the voltage of each electrolytic cell when time t=DT when the direct current pulse ends during the charge of the capacitor, and wherein D is the duration factor.

16. The method according to claim 14, wherein the configuring further comprises applying an average effective current flow circulating through each electrolytic cell defined by:

$$I_{average} = \frac{f}{V_{max} * \sqrt{D}}\left\{\frac{1}{2}C\left[\left(V_{cell}(DT)\left(1 - e^{-\frac{D/f}{RC}}\right) + V_{cell}(T)\right)^2 - V_{cell}(T)^2\right]\right\},$$

wherein $I_{average}$ is the average current flowing through each electrolytic cell, C is the capacitance of each electrolytic cell, $V_{cell}(DT)$ is the voltage of each electrolytic cell when time t=DT when the direct current pulse ends during the charge of the capacitor, e is the Euler's number, RC is the time constant representing the capacitive and resonant behavior of each electrolytic cell, and $V_{cell}(T)$ is the voltage of each electrolytic cell when time t=T.

17. The method according to claim 13, wherein the controlling further comprises providing the direct current pulse received by each of the electrolytic cells of the electrolyzer.

18. The method according to claim 13, wherein the controlling further comprises operating an activation and a deactivation of the one or more switches arranged between the energy source and the electrolyzer by controlling the duration and frequency of the direct current pulse, activating and deactivating the one or more switches supplying the electrical signal provided by the energy source sequentially, and distributing the electrical signal over the first and second groups of the electrolytic cells, wherein each group is formed by two or more electrolytic cells connected in series and wherein the certain time corresponds to the duration of the direct current pulse.

19. The method according to claim 13, further comprising extracting a product of the one or more oxidation reactions through one or more first ducts, wherein each of the one or more first ducts is in communication with an inner space of the central electrode; and extracting a product of the one or more reduction reactions through one or more second ducts, wherein each of the one or more second ducts is in communication with the inner space of the central electrode.

* * * * *